United States Patent [19]

Bafunno et al.

[11] Patent Number: 4,554,618

[45] Date of Patent: Nov. 19, 1985

[54] SWITCH, LAMP, AND CONNECTOR ASSEMBLY

[75] Inventors: Daniel V. Bafunno, Warren; Gary C. Detter, Berlin Center, both of Ohio; James D. Ehrhardt, El Paso, Tex.; Patrick J. Gaughan, West Farmington, Ohio; Dale C. Johnson, Cortland, Ohio; Richard C. Rowlands, Warren, Ohio

[73] Assignee: General Motors Corporation, Detroit, Mich.

[21] Appl. No.: 609,839

[22] Filed: May 14, 1984

[51] Int. Cl.[4] ..... H01H 3/16

[52] U.S. Cl. ..... 362/155; 362/80; 200/61.62; 200/340; 200/61.81; 200/61.82

[58] Field of Search ..... 362/80, 155, 226, 394, 362/61; 200/61.81, 61.82, 340, 61.62

[56] References Cited

U.S. PATENT DOCUMENTS

| | | | |
|---|---|---|---|
| 4,146,762 | 3/1979 | Peck | 200/61.62 |
| 4,160,887 | 7/1979 | Van Buren | 200/61.62 |
| 4,168,411 | 9/1979 | Peck | 200/61.62 |
| 4,492,833 | 1/1985 | Malesko | 200/61.81 |

OTHER PUBLICATIONS

Buick Motor Division, General Motors, Production Drawing #25509430, Jan. 20, 1981 & Sketch.

*Primary Examiner*—Ronald B. Cox

*Attorney, Agent, or Firm*—Saul Schwartz

[57] ABSTRACT

A combination switch, lamp, and connector assembly for illuminating a glove box compartment includes an insulator having an integral socket portion and an integral connector body portion, a pair of unitary contacts on the insulator extending between the socket and connector body portion, a bulb with a wedge base inserted between bifurcations on the contacts at the socket portion whereby contact is made with the bulb's filament ends and the bulb is held in the insulator, a pair of terminals inserted in the connector body portion from the side of the housing opposite the contacts and engaging leg portions of the contacts to establish electrical continuity, a plunger mounted on the insulator for linear movement from an extended to a depressed position when the glove box door is closed, and a cam on the plunger engageable on a leg portion of one of the contacts to separate that leg portion from the corresponding terminal in the depressed position of the plunger and thereby terminate compartment illumination when the glove box door is closed.

5 Claims, 11 Drawing Figures

SWITCH, LAMP, AND CONNECTOR ASSEMBLY

BACKGROUND OF THE INVENTION

1. Field of the Invention

This invention relates generally to closure actuated lamp switches and, more particularly, to an improved switch, lamp and connector assembly especially suited for economical manufacture and simplified assembly.

2. Description of the Prior Art

In automobiles, closure actuated switches are typically installed to control bulbs which illuminate the interiors of glove box or like compartments only when the compartments are open. For such applications, economy of manufacture and simplicity of assembly are particularly desirable characteristics. Efforts in these directions have resulted in a proposal wherein, for example, an insulator-contact base supports a bulb, two contacts, and a hinged operator which is actuated by the compartment closure and which, in turn, engages and lifts one of the contacts out of a circuit completing position when the closure is closed. In another proposal, an insulator-contact base supports a plunger and a pair of multiple piece contacts which, in turn, have bifurcations at corresponding first ends to engage and hold a wedge base type bulb, the plunger having a cam which engages one piece of one contact when the closure is closed to separate that piece from the second piece of the same contact and thereby interrupt the circuit through the bulb. In these and other known switch proposals, separate connectors are required to incorporate the switch into the vehicle's wiring harness. In addition, other considerations, such as complexity due to multiple components and lack of compatibility with simple bulbs of the wedge base type, reduce the attractiveness of these proposals. A switch, lamp and connector assembly according to this invention represents a novel alternative to these and other known switches.

SUMMARY OF THE INVENTION

Accordingly, the primary feature of this invention is that it provides a new and improved closure actuated switch, lamp, and connector assembly particularly suited for automobile glove box applications. Another feature of this invention resides in the provision in the new and improved assembly of an insulator-contact base with an integral socket portion and an integral connector body portion adapted for direct plug-in reception of terminals on wiring harness conductors, a cam plunger on the insulator-contact base, and a pair of unitary contacts on the insulator-contact base which support a wedge base bulb in bifurcations at correspnding first ends of the contacts located in the socket portion and which resiliently bear against the terminals at corresponding second ends located in the connector body portion, one of the contact second ends being held away from the corresponding plug-in terminal by the cam on the plunger when the latter is depressed to interrupt the circuit through the bulb. Still another feature of this invention resides in the provision in the new and improved assembly of unitary contacts having second ends which are self-biased against corresponding ones of the terminals for electrical continuity, the one second end engaged and lifted by the cam on the plunger also being self-biased back into engagement on the corresponding terminal when the plunger is extended and the cam disengaged from the contact. And a still further feature of this invention resides in the provision of guides on the insulator-contact base which engage the contacts during insertion of the latter into passages on the insulator-contact base and guide each of the contact second ends into positions obstructing subsequent passage of the terminals so that the terminals engage corresponding ones of the contacts and establish electrical continuity upon insertion into the insulator connector body portion.

These and other features of this invention will be readily apparent from the following specification and from the drawings wherein.

Figure 8A:
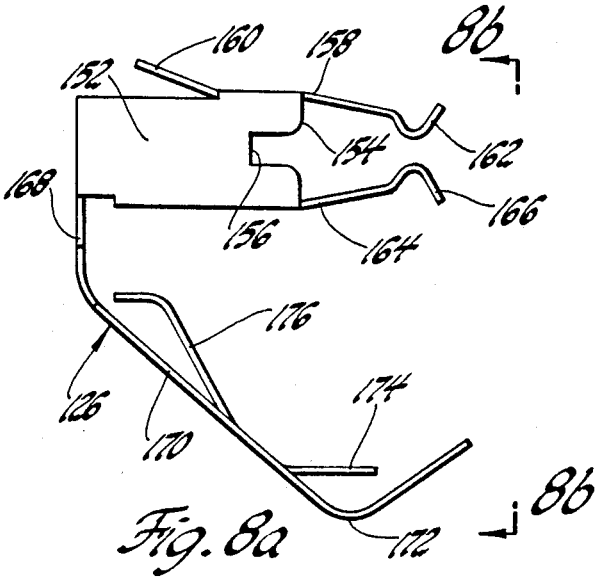
Figure 8B:
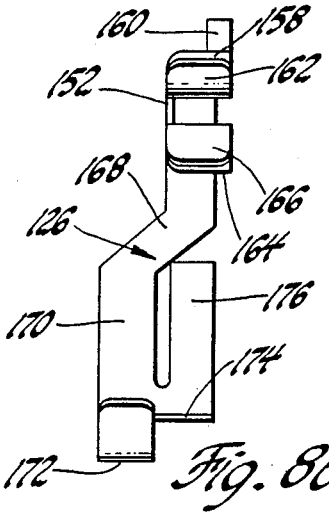
Figure 9A:
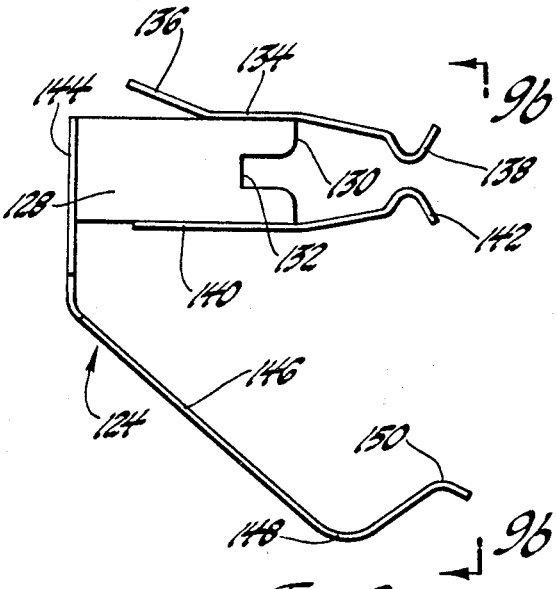
Figure 9B:
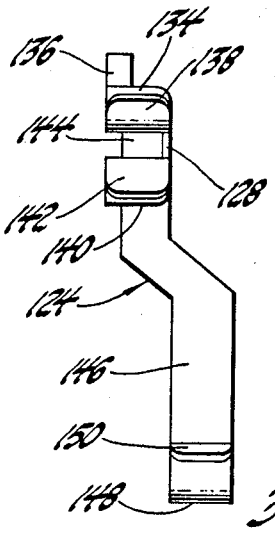

FIGS. 8*a* and 8*b* depict in side and end elevation, respectively, one unitary contact of the switch, lamp, and connector assembly according to this invention; and FIGS. 9*a* and 9*b* depict in side and end elevational views, respectively, the second unitary contact of the switch, lamp, and connector assembly according to this invention.

Referring now to FIGS. 1 through 4 of the drawings, a switch, lamp, and connector assembly according to this invention and designated 10 is adapted for installation in a generally rectangular aperture 11 in a vertical panel 12. The panel 12 may be one wall of a compartment, such as an automobile vehicle glove box, which is normally defined on five sides by a plurality of other panel members and which is opened and closed on the sixth side by a swingably mounted closure or door, not shown. Alternatively, the panel 12 may be a vertical portion of a bracket affixed to one of the panels defining the compartment. The assembly 10 includes a generally L-shaped insulator-contact support 14, referred to hereinafter as the insulator, one leg of which defines an integral connector body portion 16 and the other leg of which defines an integral socket portion 18. The insulator 14 is molded from electrically non-conductive material such as nylon and has a side 20, arbitrarily designated herein as the front side, and an opposite side 22, arbitrarily designated herein as the back side. A cover flap 23 is connected to the insulator 14 by a living hinge 24 for pivotal movement between an open position, FIG. 4, exposing the front side 20 and a closed position, FIGS. 3, 6 and 7, covering the front side.

As seen best in FIGS. 1 through 6, the socket portion 18 of the insulator has a cavity 36 opening toward the back side 22 which cavity is adapted for reception of a wedge type base 38 of a bulb 40. Conventionally, a filament 41 inside the bulb 40 terminates on the exterior of the base 38 in a pair of spaced filament ends, not shown, which, together with the filament 41, form a circuit through the bulb. A pair of parallel contact passages 42 and 44 extend through the socket portion 18 from the front side 20 to the cavity 36. An open slot 46 in the housing along the upper side of passage 42 extends generally from the cavity 36 back toward the front side 20 and terminates short of the latter at a shoulder 48. Similarly, an open slot 50 along the upper side of passage 44 extends generally from the cavity 36 toward the front side 20 and terminates at a shoulder 52. A web 54 integral with the socket portion 18 of the insulator extends transversely across the passage 42 generally midway between the front side 20 and the cavity 36. A similar web 56 integral with the socket portion 18 extends transversely across the passage 44 generally midway between the front side 20 and the cavity 36.

Referring particularly to FIGS. 3 through 6, the connector body portion 16 of the insulator includes a pair of spaced, parallel terminal passages 58 and 60. The left side passage 58 extends from the back side 22 of the insulator into a left side contact chamber 62 in the insulator located generally between the passage 58 and the passage 42 in the socket portion. The left side contact chamber 62 is open at the front side 20 of the insulator and is bounded at its lower margin by a top edge 64 of an abutment 65 in the passage 58 and on the side opposite the front side 20 by a ramp 66 which merges with a shoulder 68 parallel to the top edge 64. The passage 58 is generally rectangular in transverse cross-section and has an abutment 70, integral with the connector body portion of the insulator, located generally midway between the back side 22 and the chamber 62.

The right side passage 60 extends from the back side 22 of the insulator into a right side contact chamber 72 in the insulator located between the passage 60 and the passage 44 in the socket portion 18 and open at front side 20. The contact chamber 72 is adjacent to and separated from the contact chamber 62 by a vertical web 74 of the insulator. The passage 60 is generally rectangular in transverse cross-section and has an abutment 76 integral with the connector body portion 16 of the insulator, located generally midway between the back side 22 and the chamber 72. The chamber 72 has a flat upper edge 78, FIGS. 3 and 7, which merges generally smoothly at a shoulder 80 with a short vertical passage 82 between the passage 44 and the contact chamber 72. Likewise, a short vertical passage 84, FIG. 4, interconnects the contact chamber 62 and the passage 42 in the socket portion on the left side of the insulator. The lower side of the connector body portion 16 adjacent the back side 22 is formed by a flap 86 attached to the connector body portion by a living hinge 88, FIGS. 1, 3 and 4. The flap 86 has a hook 90, FIG. 6, adapted for engagement in a web 92 of the connector body portion to hold the flap 86 in a closed position shown in the figures. In addition, the flap 86 has a pair of integral abutments 94 and 96 which project into the passages 58 and 60, respectively, when the flap is closed.

Figure 6:
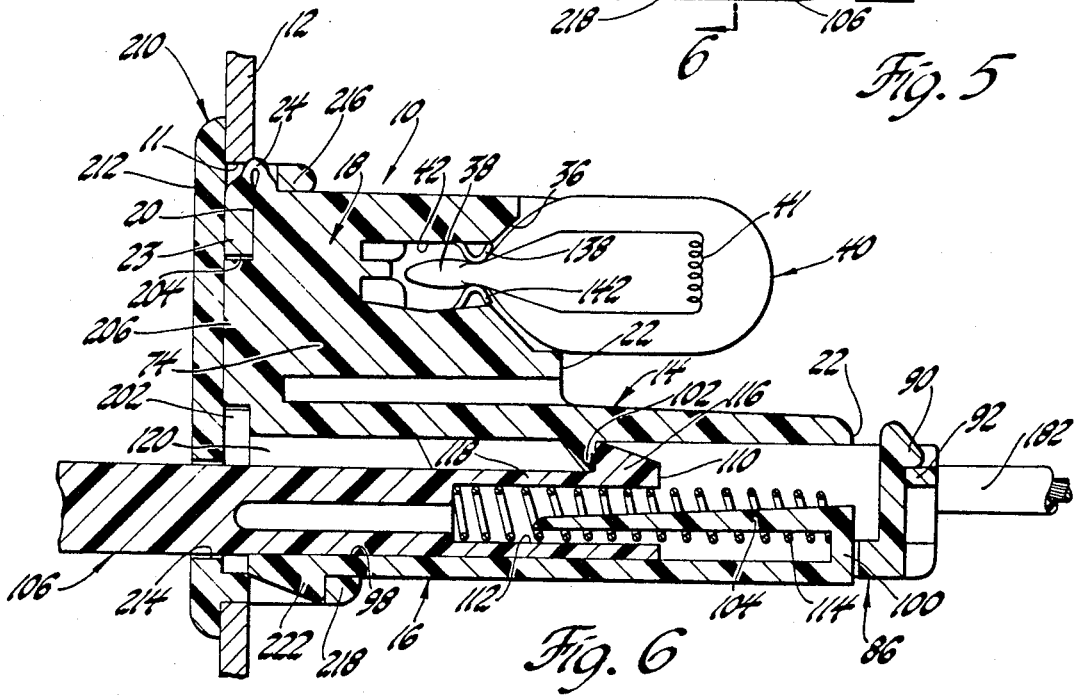
FIG. 6 is a sectional view taken generally along the plane indicated by lines 6—6 in FIG. 5 and showing the plunger in an extended position.
Figure 7:
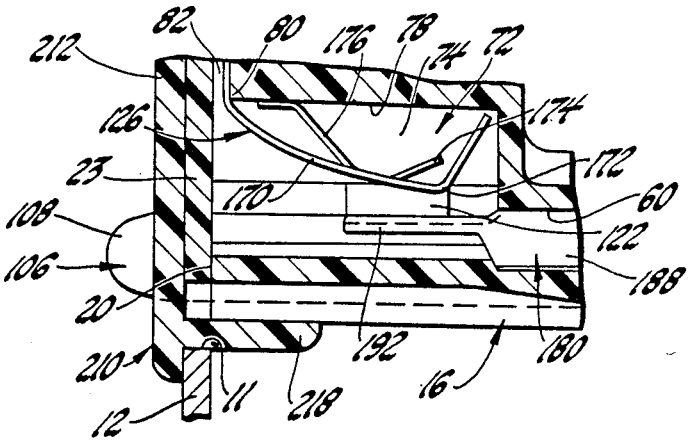
FIG. 7 is a view of a portion of FIG. 3 but with the plunger in a depressed position.

As seen best in FIGS, 3 and 5 through 7, a plunger guide passage 98 in the connector body portion 16 located midway between the passages 58 and 60 extends parallel to the passages from the front side 20 of the insulator to the back side 22 whereat an inturned lip 100, FIG. 6, closes a portion of the passage. An abutment 102, FIG. 6, integral with the connector body portion extends downward from the upper edge of the passage 98 generally midway between the ends thereof and a tapering, pinlike spring guide 104 integral with the upturned lip 100 projects axially along the passage 98 from the upturned lip toward the front side 20 of the insulator.

A plunger 106 is slidably disposed in the guide passage 98 and includes a rounded or blunt end 108 projecting outboard of the front side 20 of the insulator and a squared end 110 within the connector body portion. A stepped bore 112, FIG. 6, in the plunger 106 extends axially from the squared end toward the blunt end. The spring guide 104 projects into the stepped bore 112 and a spring 114, disposed around the spring guide 104, seats against the lip 100 and against the stepped bore 112 thereby resiliently biasing the plunger 106 outward toward an extended position limited by engagement between a hook 116 on the plunger and the abutment 102 on the connector body portion. The hook 116 is disposed at the end of a springlike arm 118, integral with the plunger but separated therefrom along the sides of the arm 118, so that the arm is flexible to a limited degree. Integral with the plunger 106 and projecting from the upper edge thereof is an axially extending guide tab 120, FIGS. 5 and 6, which slidably engages the upper edge of passage 98 to provide a bearing surface during sliding movement of the plunger. Spaced laterally from the guide tab 120 but also integral with the plunger 106 is a cam 122 which projects laterally to the right, FIG. 5, beyond the margin of the plunger 106. During sliding movement of the plunger between the extended position and a depressed position, FIG. 7, the cam 122 traverses a horizontal path within the contact chamber 72 on the right side of the insulator.

With particular reference now to FIGS. 8 and 9, a first unitary contact 124 and a second unitary contact 126 are adapted for disposition between the socket portion 18 and the connector body portion 16 of the insulator. More particularly, the contact 124 has a planar body 128 with an edge 130 having a notch 132 therein. An integral flange 134 perpendicular to the planar body 128 is upwardly splayed at one end to define a spring tang 136 and inwardly splayed at the opposite end to define a first branch 138 of a clamping bifurcation. A lower integral flange 140 perpendicular to the planar body 128 terminates in a second branch 142 of the clamping bifurcation disposed opposite the first branch 138 and spaced therefrom by a relatively small gap. Because the material from which the contact 124 is fabricated has inherent resiliency, the branches 138 and 142 are self-biased toward each other when deflected outwardly from their undeflected positions shown in FIG. 9. A third integral flange 144 perpendicular to the planar body 128 and opposite edge 130 projects down below the planar body and defines a leg 146 having a contact foot 148 and a lip 150.

As seen best in FIG. 8, the second unitary contact 126 includes a planar body 152 with an edge 154 having a notch 156 therein. An integral flange 158 perpendicular to the planar body 152 is upwardly splayed at one end to define a spring tang 160 and inwardly splayed at the opposite end to define a first branch 162 of a clamping bifurcation. A lower integral flange 164 perpendicular to the planar body 152 terminates in a second branch 166 of the clamping bifurcation disposed opposite the first branch 162 and spaced therefrom by a relatively small gap. The contact 126 is fabricated from an inherently resilient material so that the branches 162 and 166 are self-biased toward each other when deflected outwardly from their undeflected positions shown in FIG. 8. A third integral flange 168 perpendicular to the planar body 152 and opposite edge 154 projects below the planar body and defines a leg 170 having a contact foot 172 at the lower end thereof. Integral with the leg 170 the contact 126 further includes a cam engaging appendage 174 and a biasing appendage 176.

Figure 1:
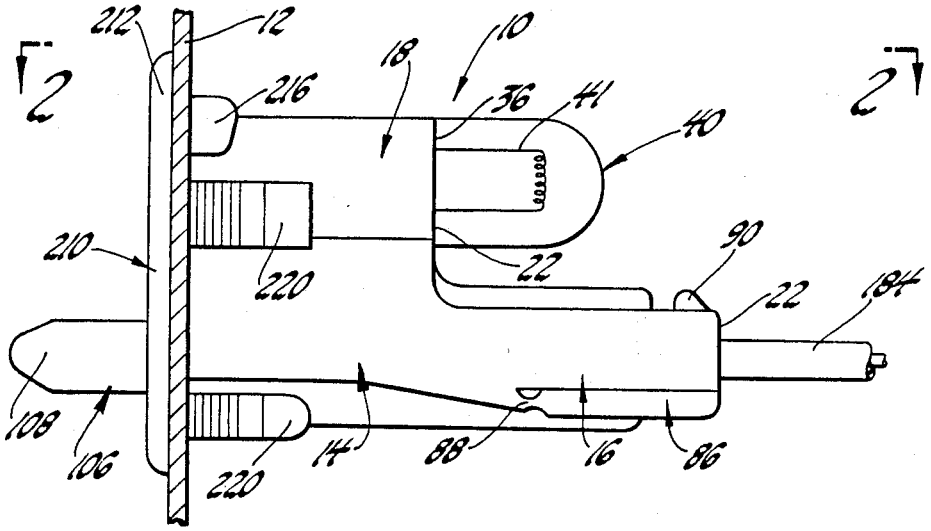
FIG. 1 is a side elevational view of a switch, lamp and connector assembly according to this invention.
Figure 2:
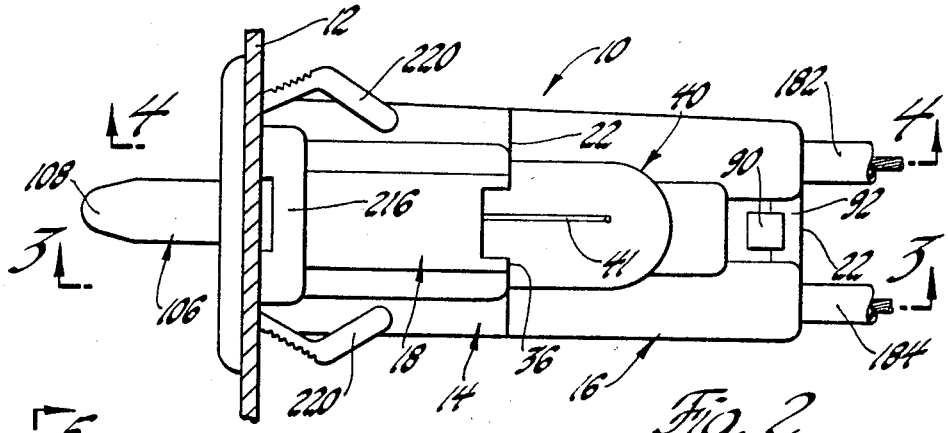
FIG. 2 is a plan view taken generally along the plane indicated by lines 2—2 in FIG. 1.
Figure 3:
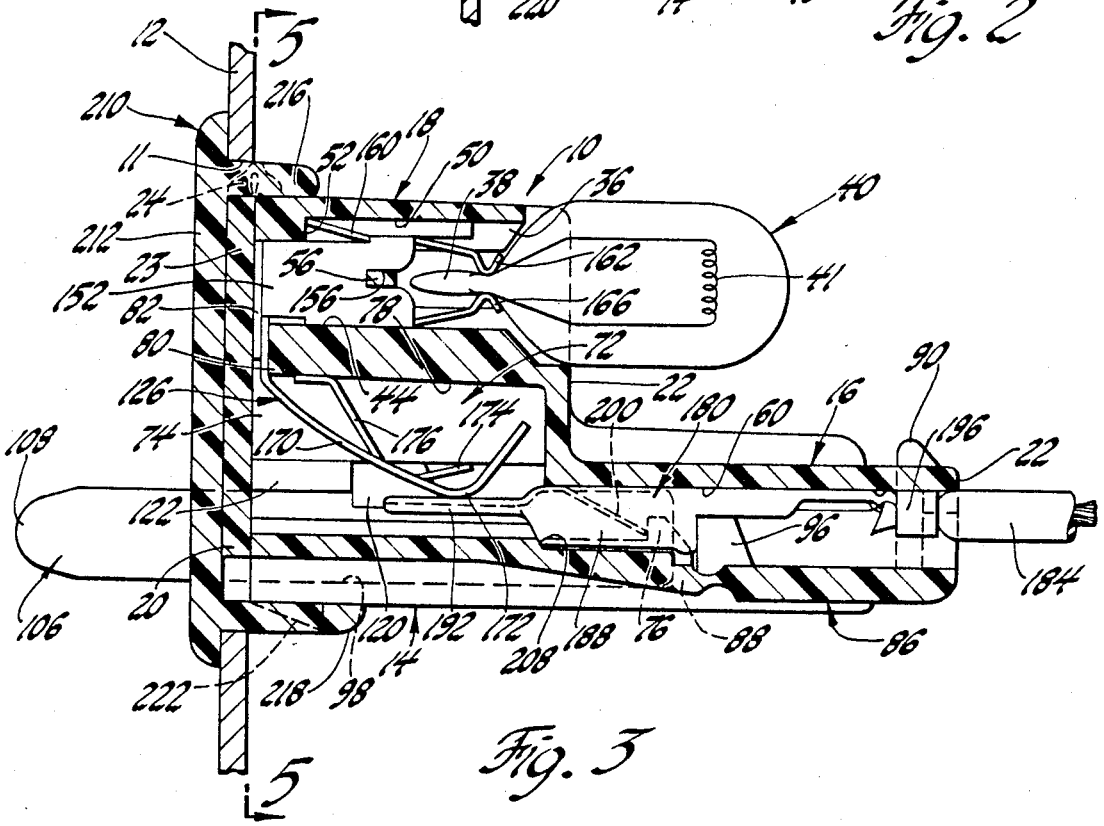
FIG. 3 is an enlarged sectional view taken generally along the plane indicated by lines 3—3 in FIG. 2.
Figure 4:
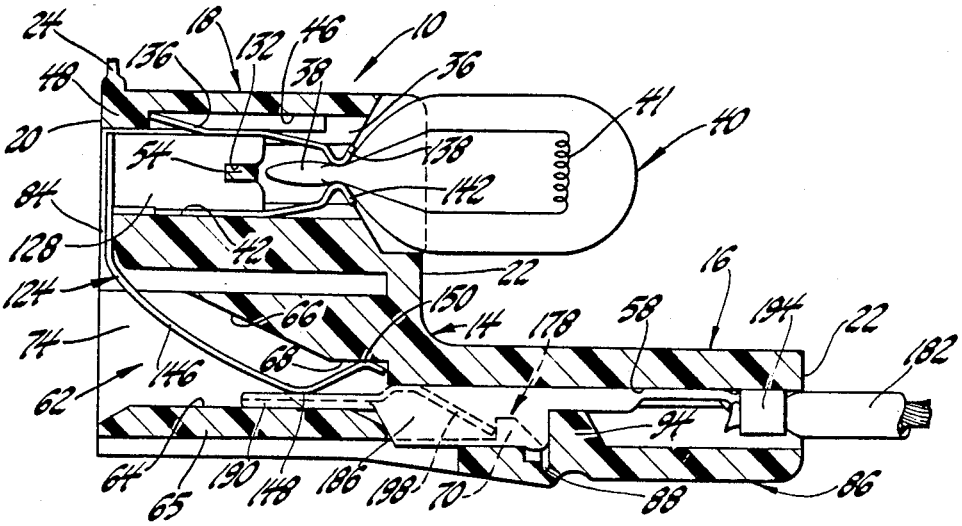
FIG. 4 is an enlarged sectional view taken generally along the plane indicated by line 4—4 in FIG. 2.
Figure 5:
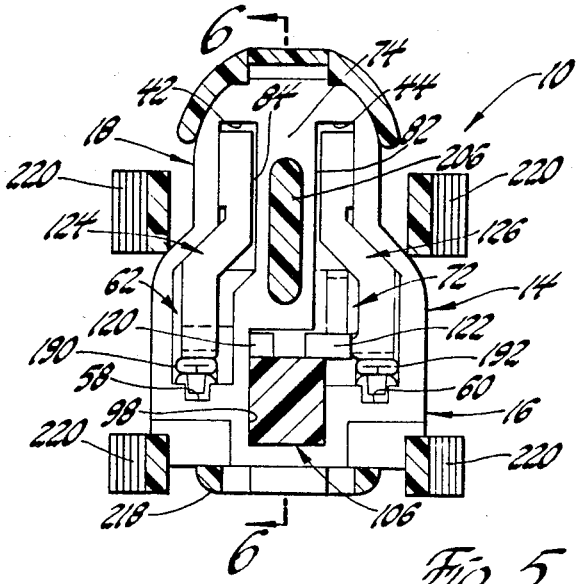
FIG. 5 is a sectional view taken generally along the plane indicated by lines 5—5 in FIG. 3.

A pair of identical terminals 178 and 180, best illustrated in FIGS. 3 and 4, are affixed to the ends of a corresponding pair of conductors 182 and 184 representing a portion of the vehicle's wiring harness normally maintained at a potential difference corresponding to battery voltage. Each of the terminals 178 and 180 has a center body portion 186 and 188, respectively, defining an inverted channel in transverse cross-section, a flat end or blade 190 and 192, respectively, and a crimping portion 194 and 196, respectively. Corresponding ones of a pair of spring tangs 198 and 200 on the terminals 178 and 180, respectively, project down into the center body portions while the crimping portions 194 and 196 are squeezed around the conductors 182 and 184, respectivly, with electrical continuity between the cores of the conductors and the terminals and with the insulating covers on the conductors secured to the terminals.

Describing, now, a typical or representative assembly sequence of the switch, lamp, and connector assembly 10 and installation thereof on the panel 12, with the terminals 178 and 180 having been previously affixed to the ends of the conductors 182 and 184 as part of the fabrication of the wiring harness, the plunger 106 is first installed on the insulator 14. More particularly, with the flap 23 in an open position exposing front side 20 of the insulator, the spring 114 is installed over the spring guide 104. The squared end 110 of the plunger is then inserted into the plunger guide passage 98 through the front side 20 as the abutment 102 cams the hook 116 inwardly allowing movement of the plunger to the depressed position. After hook 116 passes the abutment the inherent resilience of the arm 118 lifts and maintains the hook 116 behind the abutment foreclosing subsequent axial separation between the insulator and the plunger and defining the extended position of the latter.

Next in sequence, one of the contacts 124 and 126, 126 for example, is mounted on the insulator by insertion of planar body 152 into the guide passage 44 in the socket portion 18 from the front side 20 until web 56 is received within notch 156 of the planar body. Generally concurrently with reception of the web in the notch, the spring tang 160, being previously sprung inward as the planar body passes under the shoulder 52, springs outwardly behind the shoulder thereby locking the planar body between the web 56 and the shoulder 52 and the contact 126 on the insulator. In this installed position of the contact, the branches 162 and 166 of the clamping bifurcation are disposed generally at the base of cavity 36 while the leg 170 projects through the short vertical passage 82 into the contact chamber 72. Of importance is the fact that as the planar body 152 is inserted in the guide passage 44, the biasing appendage 176 on the leg 170 engages the shoulder 80 and is guided thereby onto the flat upper edge 78 of the contact chamber 72. The biasing appendage 176 thus functions to positively locate the contact foot 172 in a predetermined position across the path to be traversed by the terminal 180 as described hereinafter regardless of whether the leg may have inadvertently deformed during manufacture and/or subsequent handling.

Next in sequence, the planar body 128 of the other contact 124 is similarly inserted in the guide passage 42 in the socket portion of the insulator through the front side 20 until the web 54 is received within the notch 132. Concurrently, the spring tang 136, cammed inward as the planar body passes the shoulder 48, springs out behind the shoulder thereby locking the planar body between the web 54 and the shoulder 48 and the contact 124 on the insulator. In this position, the branches 138 and 142 of the clamping bifurcation are disposed at the base of the cavity 36 and in spaced parallel relationship to the branches 162 and 166 on the previously installed contact 126. Concurrently with insertion of the planar body 128 into the passage 42 the leg 146 of the contact enters the open end of contact chamber 62 with lip 150 engaging the ramp 66. As insertion of the planar body 128 continues, the ramp 66 guides the lip 150 onto the shoulder 68 thereby positioning the foot 148 across the path of movement later to be traversed by the blade 190 of terminal 178 as described hereinafter. When fully inserted, the contact 124 extends from the passage 42 to the contact chamber 62 through the short vertical passage 84.

Next in sequence, the front side 20 of the insulator may be closed by folding over cover flap 23. The flap has an appropriate notch 202 for avoiding interference with the plunger 106 and a slot 204, FIG. 6, for reception of a rib 206 on the vertical web 74 which rib is heat staked to the flap for holding the latter closed. Additionally, the bulb 40 may be installed by insertion of the base 38 thereof between the branches of the laterally spaced, parallel bifurcations on the contacts 124 and 126. The base 38 outwardly deflects the branches which thereafter tightly grip the base for holding the bulb on the insulator while simultaneously bearing against the filament ends to complete a circuit between the contacts 124 and 126 through the filament 41 of the bulb.

Depending upon the particular circumstances, the insulator 14 may now be either mounted on the panel 12 or connected to the vehicle's wiring harness. Assuming the latter step to be most convenient, the terminals 178 and 180 are simply plugged into the connector body portion 16 through the back side 22 of the insulator. More particularly, with the flap 86 in an open position, not shown, exposing the passages 58 and 60, the terminal 178 is inserted from the back side 22 into the passage 58 with the blade 190 traversing a horizontal path obstructed by the foot 148 of contact 124. At an intermediate position, not shown, the blade 190 engages the foot 148 and cams the latter and the leg 146 upwardly, FIG. 4, so that the terminal may be fully inserted to an installed position, FIG. 4, defined by engagement between the center body portion 186 of the terminal and the abutment 65 in the contact chamber 62. In the installed position, the spring tang 198 bears against the abutment 70 to lock the terminal on the insulator. With the terminal 178 thus installed, the lip 150 is flexed between the blade 190 and the shoulder 68 thereby resiliently self-biasing the foot 148 against the blade to assure positive electrical continuity therebetween.

The other terminal 180 is likewise plugged into passage 60 of the connector body portion 16 along a path of movement obstructed by the foot 172 on the leg 170 of the contact 126. At an intermediate position, not shown, the blade 192 engages the foot 172 and cams the latter and the leg 170 upwardly, FIG. 3, so that the terminal may be fully inserted to an installed position, FIG. 3, defined by engagement between the center body portion 188 of the terminal and a shoulder 208 at the base of contact chamber 72. In the installed position, the spring tang 200 bears against the abutment 76 to lock the terminal on the insulator. As the foot 172 is deflected upwardly and the leg 170 correspondingly flexed, the biasing appendage 176 is also flexed between the upper edge 78 of the chamber 72 and the connection of the appendage to the leg 170. The biasing appendage thus exerts a resilient self bias on the leg 170 urging the foot 172 against the blade 192 of the terminal 180 and assuring positive electrical continuity therebetween. An electrical circuit for illuminating the bulb 40 is thus completed between the conductors 182 and 184. After the terminals 178 and 180 are plugged into the connector body prtion 16, the flap 86 is closed against the insulator with hook portion 90 engaging web 92 to even more positively connect the terminals to the insulator.

The insulator 14, with bulb 40 and terminals 178 and 180 plugged in, is installed on the panel 12 through cooperation with a bezel 210. More particularly, the bezel 210 has a flat trim portion 212 with a plunger aperture 214 therethrough, an integral upper apertured tab 216, an integral lower apertured tab 218, and a plurality of spring arms 220. The bezel is positioned on the front side of the panel 12 with tabs 216 and 218 and arms 220 all projecting through the aperture 11 and with trim portion 212 abutting the panel. The insulator 14, positioned behind the panel, is brought into aperture 11 with plunger 106 projecting through plunger aperture 214 in the bezel. As the insulator approaches a position wherein the flap 23 is disposed in the panel aperture 11, the upper tab 216 snaps over the flexed living hinge 24 while the lower tab 218 snaps over a hook 222 on the bottom of the insulator whereby the bezel and the insulator are tightly clamped together. The unified bezel and insulator are, in turn, held in the panel aperture 11 by the spring arms 220 which grip the margins of the aperture to prevent the insulator from being withdrawn through the front of the panel 12.

Describing, now, the operation of the switch, lamp, and connector assembly 10, when the glove box door, not shown, is open, the plunger assumes the extended position under the thrust of spring 114 as limited by the abutment 102. Accordingly, a circuit between the conductors 182 and 184 is completed through the terminals 178 and 180, the contacts 124 and 126, and the filament 41 which is thus energized to illuminate the interior of the glove box. As the glove box door is closed, a portion thereof engages the blunt end 108 of the plunger 106 and affects movement of the latter from the extended position toward the depressed position, FIG. 7, concurrently with movement of the door to a fully closed position. As the plunger traverses the linear distance between the extended and depressed positions, the cam 122 on the plunger engages the appendage 174 on the leg 170 of the contact 126 whereupon the appendage is cammed upwardly as the cam passes under the appendage. The leg 170 is thus flexed upwardly causing the foot 172 to separate from the blade 192 of the terminal 180 thereby interrupting the circuit between the conductors 182 and 184 and terminating energization of the filament 41. The appendage 174 is maintained in engagement on the top of the cam 122 by the bias appendage 176 which is further flexed as the leg 170 is separated from the blade 192. Accordingly, so long as the glove box door is maintained closed, the asssembly 10 prevents illumination of the compartment. When the glove box door is reopened, the spring 114 projects the plunger 106 to the extended position during which movement the cam 122 slides out from under appendage 174 allowing the resilient self-bias of the bias appendage 176 to thrust the foot 172 against the blade 192 for reestablishing electrical continuity.

The embodiments of the invention in which an exclusive property or privilege is claimed are defined as follows:

1. A closure actuated switch, lamp, and connector assembly for illuminating a compartment comprising, an insulator having a front side and a back side and including an integral socket portion and an integral connector body portion, means mounting said insulator adjacent said compartment, first passage means in said insulator including a pair of parallel contact passages in said socket portion between said front and said back sides, second passage means in said insulator including a pair of parallel terminal passages extending from said back toward said front side, a pair of unitary contacts each having a body portion adapted for plug-in reception from said front side in respective ones of said contact passages and an integral leg portion concurrently extending into a corresponding one of said terminal passages, a bulb, means operative to support said bulb on said socket portion and to define an electrical circuit through said bulb from one of said contact body portions to the other, a pair of terminals on respective ones of a pair of conductors, each of said terminals being received in plug-in fashion from said back side in respective ones of said terminal pasages and engaging the corresponding one of said contact leg portions to complete a circuit between said conductors through said bulb for energizing the latter, and cam and plunger means on said insulator operable by said closure in response to compartment closing movement thereof to separate one of said contact leg portions from the corresponding one of said terminals and interrupt the circuit through said bulb whereby illumination of said compartment is terminated.

2. The switch, lamp, and connector assembly recited in claim 1 wherein said bulb includes wedge type base with a pair of spaced filament ends thereon and said bulb mounting means includes a pair of self-biased bifurcations on each of said contact body portions, each of said bifurcation pairs receiving therebetween said bulb base and engaging one of said filament ends whereby said bulb is supported on said insulator and a circuit is completed between said contacts through said bulb.

3. The switch, lamp, and connector assembly recited in claim 2 wherein said cam and plunger means includes a plunger supported on said insulator for linear sliding movement between an extended position when said compartment closure is open and a depressed position when said compartment closure is closed, a cam integral with said plunger engageable on said one leg portion in said plunger depressed position and operative to separate said one leg portion from the corresponding one of said terminals to interrupt the circuit through said bulb, and a spring disposed between said plunger and said insulator biasing said plunger to said extended position.

4. The switch, lamp, and connector assembly recited in claim 3 wherein said first passage means includes a first contact chamber in said socket portion between a first of said contact passages and a first of said terminal passages, a second contact chamber between a second of said contact passages and a second of said terminal passages, and guide means in each of said contact chambers engageable on respective ones of said contact leg portions during insertion of said contact body portions in said contact passages and operable to guide said respective leg portions to positions obstructing the paths of movement of said terminals during insertion of the latter in said terminal passages from said back side so that said terminals engage said leg portions upon insertion.

5. The switch, lamp, and connector assembly recited in claim 4 further including integral appendages on each of said contact leg portions resiliently flexed against a surface of the correspnding one of said contact chambers when each of said leg portions engages the corresponding one of said terminals so that each of said leg portions is positively biased against the corresponding one of said terminals, the one of said integral appendages on said one of said contact leg portions that is engaged by said plunger cam being further flexed as said plunger moves to said depressed position so that said one leg portion is biased back against the corresponding one of said terminals when said plunger returns to said extended position.

* * * * *